US008616549B2

(12) United States Patent
Hayashi et al.

(10) Patent No.: US 8,616,549 B2
(45) Date of Patent: Dec. 31, 2013

(54) STORAGE MEDIUM AND IMAGE FORMING APPARATUS

(75) Inventors: Kohei Hayashi, Okazaki (JP); Yoshihiko Yoshizaki, Kokubunji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 209 days.

(21) Appl. No.: 13/331,799

(22) Filed: Dec. 20, 2011

(65) Prior Publication Data

US 2012/0155942 A1 Jun. 21, 2012

(30) Foreign Application Priority Data

Dec. 20, 2010 (JP) ..... 2010-282789

(51) Int. Cl.
*B65H 7/00* (2006.01)

(52) U.S. Cl.
USPC . 271/256; 271/258.01; 271/259; 271/265.01; 271/265.02

(58) Field of Classification Search
USPC ..... 271/256, 258.01, 259, 265.01, 265.02; 399/12, 13, 75
See application file for complete search history.

(56) References Cited

U.S. PATENT DOCUMENTS 4,970,544 A 11/1990 Furusawa et al.

FOREIGN PATENT DOCUMENTS

| | | |
|---|---|---|
| JP | 1-139471 | 5/1989 |
| JP | 2001-341873 | 12/2001 |
| JP | 2002-53245 | 2/2002 |
| JP | 2002-287578 | 10/2002 |
| JP | 2004-292150 | 10/2004 |
| JP | 2005-298168 | 10/2005 |
| JP | 2006-303569 | 11/2006 |
| JP | 2007-316131 | 12/2007 |

OTHER PUBLICATIONS

Decision to Grant Patent mailed Jan. 23, 2013, directed to Japanese Application No. 2010-282789; 6 pages.

*Primary Examiner* — David H Bollinger
(74) *Attorney, Agent, or Firm* — Morrison & Foerster LLP

(57) ABSTRACT

A computer readable storage medium stores a feeding and conveyance control program. The feeding and conveyance control program causes a computer to perform executing sequence control of a feeding sequence module with respect to a feeding mechanism that feeds the recording medium. The sequence control includes two kinds of sequence control executed in accordance with an identifier indicating whether the vertical conveyance mechanism exists. Sequence control of a vertical conveyance sequence module is executed with respect to a vertical conveyance mechanism that relays conveyance of the recording medium. Sequence control of a resist conveyance sequence module is executed with respect to a resist conveyance mechanism that conveys the recording medium to the transfer position at a predetermined timing. Overall management of the above-described modules is executed. The overall management includes determining, based on the identifier, whether to execute the sequence control of the vertical conveyance sequence module.

9 Claims, 8 Drawing Sheets

With vertical conveyance mechanism

STORAGE MEDIUM AND IMAGE FORMING APPARATUS

CROSS-REFERENCE TO RELATED APPLICATIONS

The present application claims priority under 35 U.S.C. §119 to Japanese Patent Application No. 2010-282789, filed Dec. 20, 2010. The contents of this application are incorporated herein by reference in their entirety.

BACKGROUND OF THE INVENTION

1. Field of the Invention

The present invention relates to a storage medium and an image forming apparatus.

2. Discussion of the Background

Electrographic image forming apparatuses employ two kinds of methods of conveying a fed recording medium to resist rollers. One of the methods involves use of a sheet feed roller alone, and the other method involves use of a sheet feed roller and a vertical conveyance roller (which may also be referred to as an intermediate conveyance roller) disposed further downstream than the sheet feed roller.

For example, Japanese Unexamined Patent Application Publication No. 2007-316131 discloses an image forming apparatus without a vertical conveyance roller, while Japanese Unexamined Patent Application Publication No. 2005-298168 discloses an image forming apparatus with a vertical conveyance roller

SUMMARY OF THE INVENTION

According to one aspect of the present invention, a computer readable storage medium stores a feeding control program for controlling a recording medium to be fed and conveyed to a transfer position. The feeding control program causes a computer to perform executing sequence control of a feeding sequence module with respect to a feeding mechanism configured to feed the recording medium. The sequence control includes two kinds of sequence control executed in accordance with an identifier indicating whether the vertical conveyance mechanism exists. Sequence control of a vertical conveyance sequence module is executed with respect to a vertical conveyance mechanism configured to relay conveyance of the recording medium. Sequence control of a resist conveyance sequence module is executed with respect to a resist conveyance mechanism configured to convey the recording medium to the transfer position at a predetermined timing. Overall management of the feeding sequence module, the vertical conveyance sequence module, and the resist conveyance sequence module is executed. The overall management includes determining, based on the identifier, whether to execute the sequence control of the vertical conveyance sequence module.

According to another aspect of the present invention, an image forming apparatus includes the above-described storage medium.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
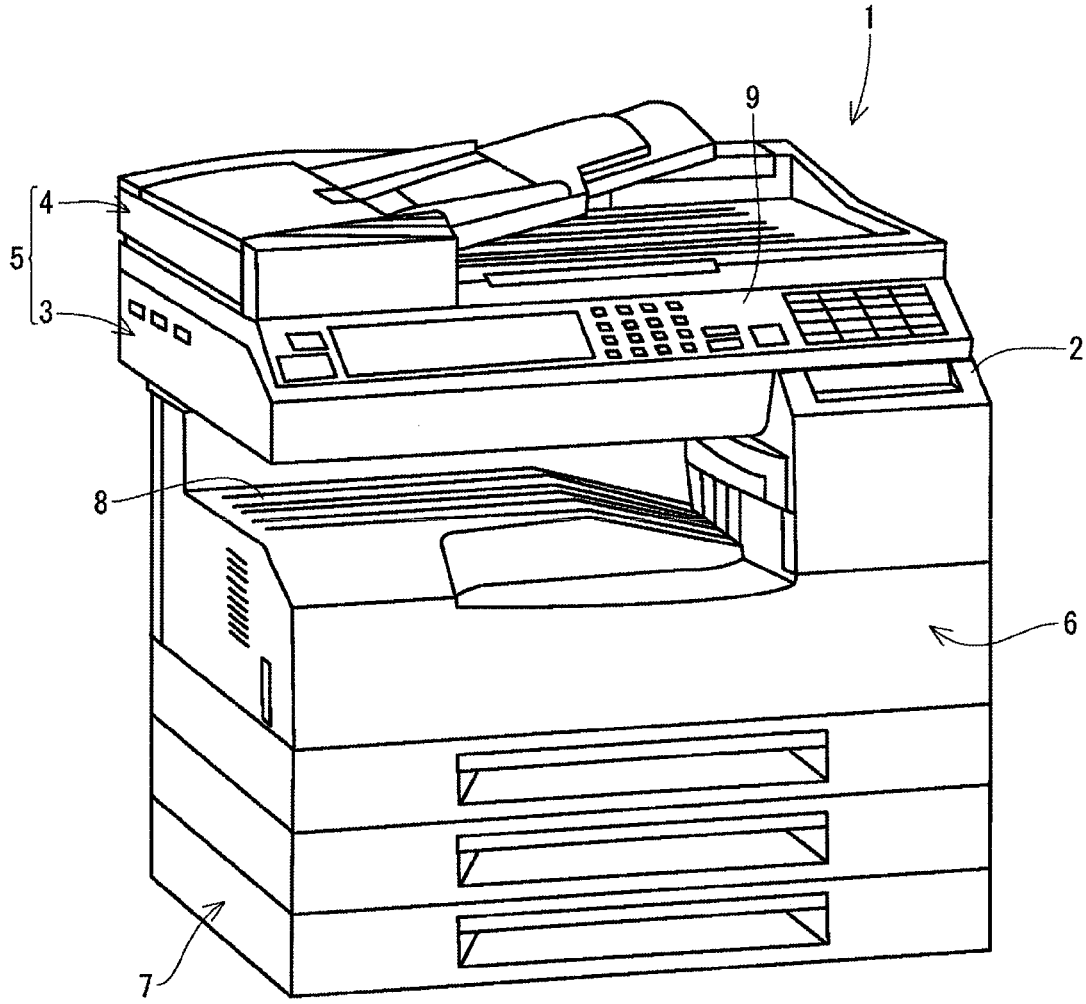
FIG. 1 is a perspective view of an MFP.

The embodiments will now be described with reference to the accompanying drawings, wherein like reference numerals designate corresponding or identical elements throughout the various drawings.

In this embodiment, a multi-functional printer 1 (hereinafter referred to as an MFP) will be described as an exemplary image forming apparatus.

The MFP 1 shown in FIG. 1 has multiple functions including a copying function, a scanning function, a printing function, and a facsimile function, and is capable of data communications through networks such as a LAN and a phone line. Specifically, the MFP 1 is capable of outputting image data read from a document model to another computer through a network, or inputting image data from another computer through a network and printing the image data, or transmitting and receiving FAX data.

An image reader 5 is disposed above a main body 2 of the MFP 1, and includes a scanner 3 and an automatic document feeder (hereinafter referred to as an ADF) 4. The image reader 5 synchronizes the scanner 3 with the ADF 4 so as to optically read an image on each document model set in the ADF 4, thus acquiring image data. Specifically, the ADF 4 conveys document models to the scanner 3 one at a time, and the scanner 3 reads the image on each document model when each document model passes through a predetermined reading position, thus acquiring image data.

A feeder 7 (sheet feed and conveyance unit) is disposed below the main body 2 so as to feed and convey recording sheets of media P to a transfer position 24 of an image processor 6 (see FIG. 2). The image processor 6 is disposed in the main body 2 between the image reader 5 and the feeder 7 so as to print a toner image onto the recording sheet of media P. The feeder 7 supplies the recording sheets of media P to the image processor 6 one at a time. The image processor 6 prints a toner image onto the recording sheet of media P based on image data acquired by the image reader 5 or through a network. The main body 2 has a recessed space between the image reader 5 and the image processor 6 so as to provide a discharged sheet reservoir 8. The discharged sheet reservoir 8 is where recording sheets of media P loaded with toner images through the image processor 6 are discharged.

An operation panel 9, which includes a plurality of keys (buttons), is disposed on a front side (forward side) of the main body 2. A user operates the keys by referring to a display screen and the like on the operation panel 9 when the user executes various kinds of setting of a function selected from the various functions of the MFP 1 and instructs the MFP 1 to execute processing. The main body 2 includes a controller 10 (see FIG. 3) in charge of overall management of the MFP 1. The controller 10 is not shown in FIG. 2.

Figure 2A:
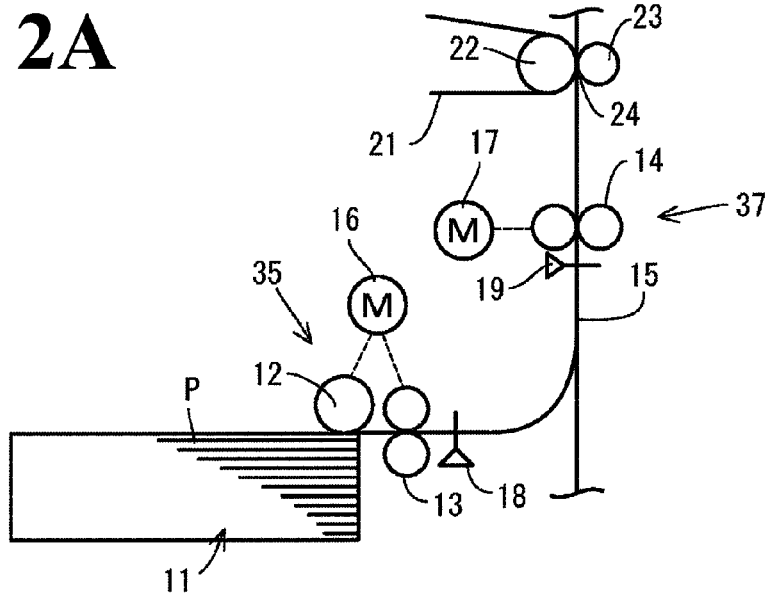
FIG. 2A is a schematic explanatory view of a feeder without a vertical conveyance mechanism.
Figure 2B:
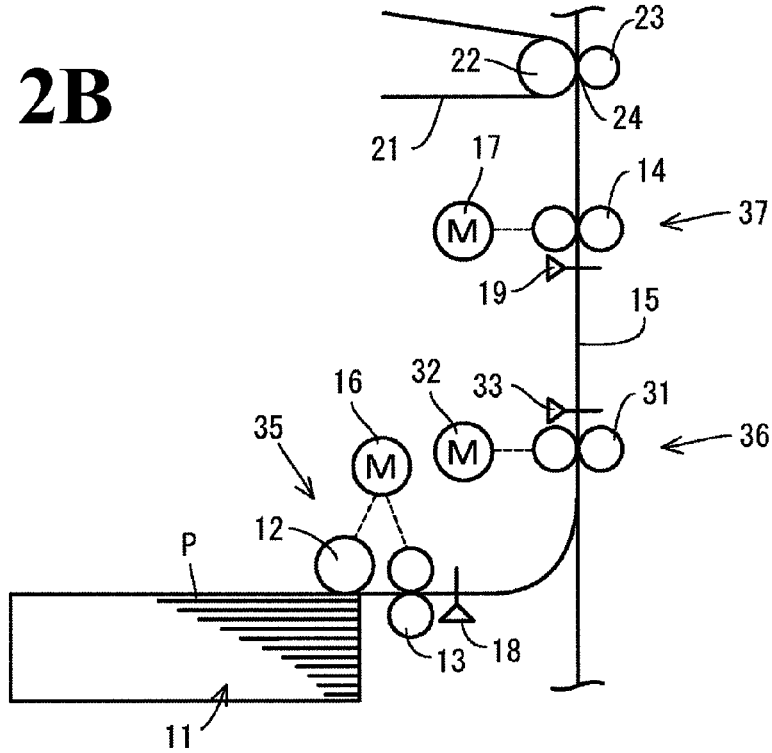
FIG. 2B is a schematic explanatory view of a feeder with a vertical conveyance mechanism.

FIG. 2 is a schematic explanatory view of the feeder 7. FIG. 2A shows the case where a vertical conveyance mechanism 36 (described in detail later) does not exist, while FIG. 2B shows the case where the vertical conveyance mechanism 36 exists. First, configurations and elements that are common throughout FIGS. 2A and 2B are described. As shown in FIGS. 2A and 2B, the feeder 7 includes a sheet feed cassette 11, a pick-up roller 12, a pair of feeding rollers 13, and a pair of resist rollers 14. The sheet feed cassette 11 accommodates the recording sheets of media P. The pick-up roller 12 picks up the recording sheets of media P in the sheet feed cassette 11 one at a time starting from the uppermost sheet. The pair of feeding rollers 13 are disposed further downstream than the pick-up roller 12 in the conveyance direction. The pair of resist rollers 14 convey the individual sheets of recording media P, one by one, to the image processor 6 at a predetermined timing. The recording sheets of media P in the sheet feed cassette 11 are sent to a conveyance path 15 one at a time starting from the uppermost sheet by the rotation of the pick-up roller 12 and the pair of feeding rollers 13. The conveyance path 15 serves as a path through which the recording sheets of media P are subjected to the printing process. The pick-up roller 12 and the pair of feeding rollers 13 are drivingly rotated by a feeding motor 16, which serves as a driving source. The pair of resist rollers 14 are drivingly rotated by a resist motor 17, which serves as a driving source.

Along the conveyance path 15, a feeding sensor 18 is disposed adjacent to and further downstream than the pair of feeding rollers 13 in the conveyance direction. The feeding sensor 18 serves as a feeding detector to detect the recording sheets of media P. Along the conveyance path 15, a resist sensor 19 serving as a resist detector is disposed adjacent to and further upstream than the pair of resist rollers 14 in the conveyance direction. The sensors 18 and 19 detect, at their respective positions, whether a recording sheet of media P exists. The sensors 18 and 19 each may be of an optical non-contact type or a contact type including an actuator such as a sensing arm.

The image processor 6 is disposed further downstream than the pair of resist rollers 14 in the conveyance direction. The image processor 6 transfers toner images on respective photoreceptor drums, which are exemplary image carriers, to the recording sheet of media P. The image processor 6 includes an intermediate transfer belt 21 and a total of four image forming units (not shown) respectively corresponding to colors of yellow (Y), magenta (M), cyan (C), and black (K). The intermediate transfer belt 21 is wound around a driving roller 22 and the like, and is drivingly rotatable in the anti-clockwise direction in FIG. 2. A secondary transfer roller 23 is disposed on the circumstantial side of a portion of the intermediate transfer belt 21 wound around the driving roller 22. The intermediate transfer belt 21 and the secondary transfer roller 23 define, at the portion of their contact, the transfer position 24.

Next, configurations and elements unique to FIG. 2B will be described. In the example of FIG. 2B, a pair of vertical conveyance rollers 31, which relay the conveyance of the recording sheets of media P that have been fed, are disposed along the conveyance path 15 between the pair of feeding rollers 13 and the pair of resist rollers 14. The pair of vertical conveyance rollers 31 are drivingly rotated by a vertical conveyance motor 32, which serves as a driving source. Along the conveyance path 15, a vertical conveyance sensor 33 is disposed adjacent to and further downstream than the pair of vertical conveyance rollers 31 in the conveyance direction. The vertical conveyance sensor 33 serves as a vertical conveyance detector to detect the recording sheets of media P. Similarly to the sensors 18 and 19, the vertical conveyance sensor 33 detects, at its position, whether a recording sheet of media P exists. The vertical conveyance sensor 33 may be of an optical non-contact type or a contact type including an actuator.

As described in detail later, in the example of FIG. 2A without the vertical conveyance mechanism 36, the pair of feeding rollers 13 alone assume the role of feeding the recording sheets of media P and the role of adjusting the conveyance timing associated with the transfer position 24 (the adjustment includes skew correction and loop formation). In the example of FIG. 2B with the vertical conveyance mechanism 36, the pair of feeding rollers 13 assume the role of feeding the recording sheets of media P, while the pair of vertical conveyance rollers 31 assume the role of adjusting the conveyance timing associated with the transfer position 24. In other words, the pair of feeding rollers 13 and the pair of vertical conveyance rollers 31 implement role sharing.

Overview of the printing operation of a recording sheet of media P is as follows. The toner images of the respective colors are primary transferred by the respective image forming units onto the intermediate transfer belt 21, where the toner images are superimposed one on top of each other. The recording sheet of media P is conveyed to the transfer position 24 by the pair of resist rollers 14 at the timing when the toner images of the respective colors move to the transfer position 24 by the driving rotation of the intermediate transfer belt 21. The superimposed toner images of the respective colors are collectively secondary transferred onto the recording sheet of media P when the recording sheet of media P passes through the transfer position 24. The recording sheet of media P past the transfer position 24 and loaded with an unfixed toner image on one side is heated and pressed through a fixing portion (not shown). Thus, the unfixed toner image is fixed on the recording sheet of media P. The recording sheet of media P after the fixing (printing) is discharged into the discharged sheet reservoir 8.

The pick-up roller 12, the pair of feeding rollers 13, the feeding motor 16, and the feeding sensor 18 constitute a feeding mechanism 35. The pair of resist rollers 14, the resist motor 17, and the resist sensor 19 constitute a resist conveyance mechanism 37. The pair of vertical conveyance rollers 31, the vertical conveyance motor 32, and the vertical conveyance sensor 33 constitute the vertical conveyance mechanism 36.

Figure 3:
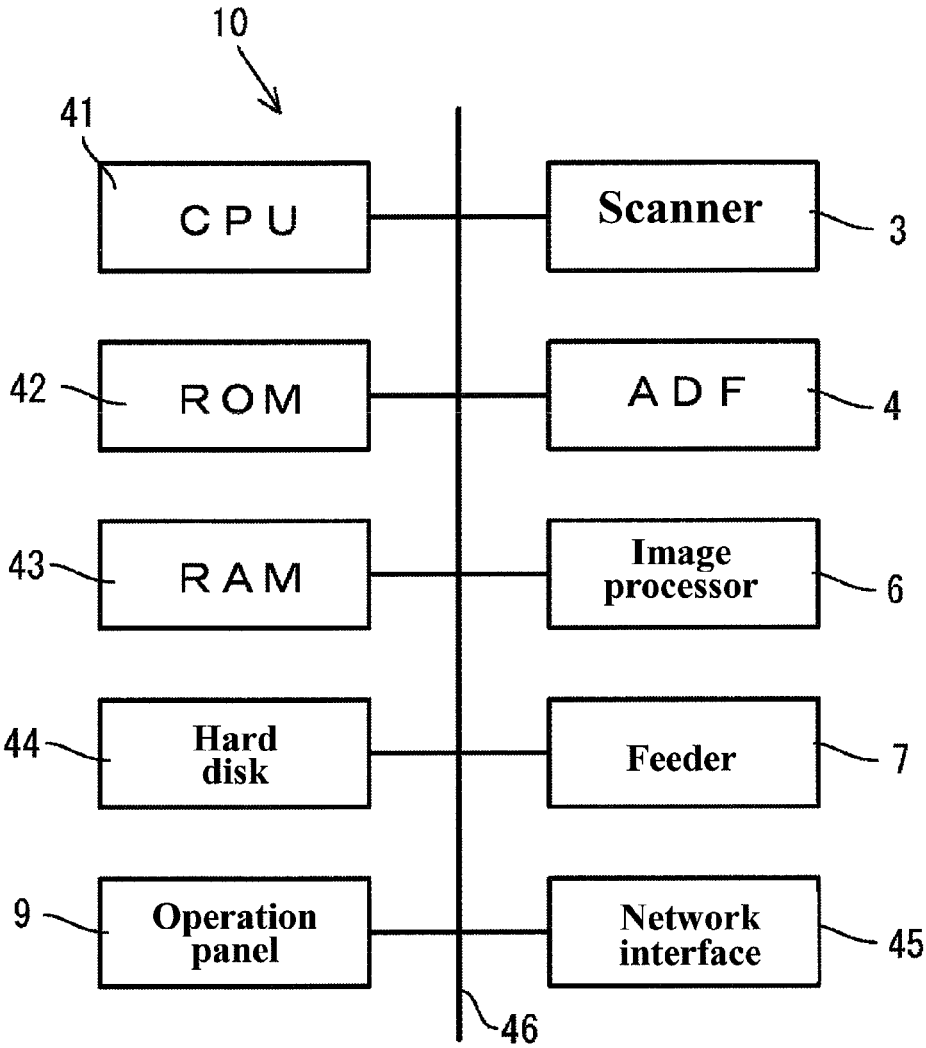
FIG. 3 is a block diagram illustrating a controller.

FIG. 3 is a functional block diagram illustrating the controller 10, which is in charge of overall management of the MFP 1. The controller 10 receives an image signal from an external terminal, the scanner 3, or the like, and converts the image signal into digital image data for the colors Y, M, C, and K. Then, the controller 10 controls the image processor 6, the feeder 7, and the like to execute a printing operation. The controller 10 according to this embodiment includes a CPU 41, a ROM 42, a RAM 43, a hard disk 44 as a storage medium, and a network interface 45. The elements 41 to 45 and the components (the scanner 3, the ADF 4, the image processor 6, the feeder 7, and the operation panel 9) are coupled to each other via a communication bus 46, through which data such as various signals are exchanged.

The CPU 41 executes various kinds of arithmetic operations and control. The ROM 42 stores various programs, including BIOS, and data. The RAM 43 serves as a work area to temporarily store programs and data. The hard disk 44 stores various control programs, including an operating system, and data. The network interface 45 is a physical interface for communication with other devices such as an external terminal through a network such as a LAN and a phone line.

Figure 4:
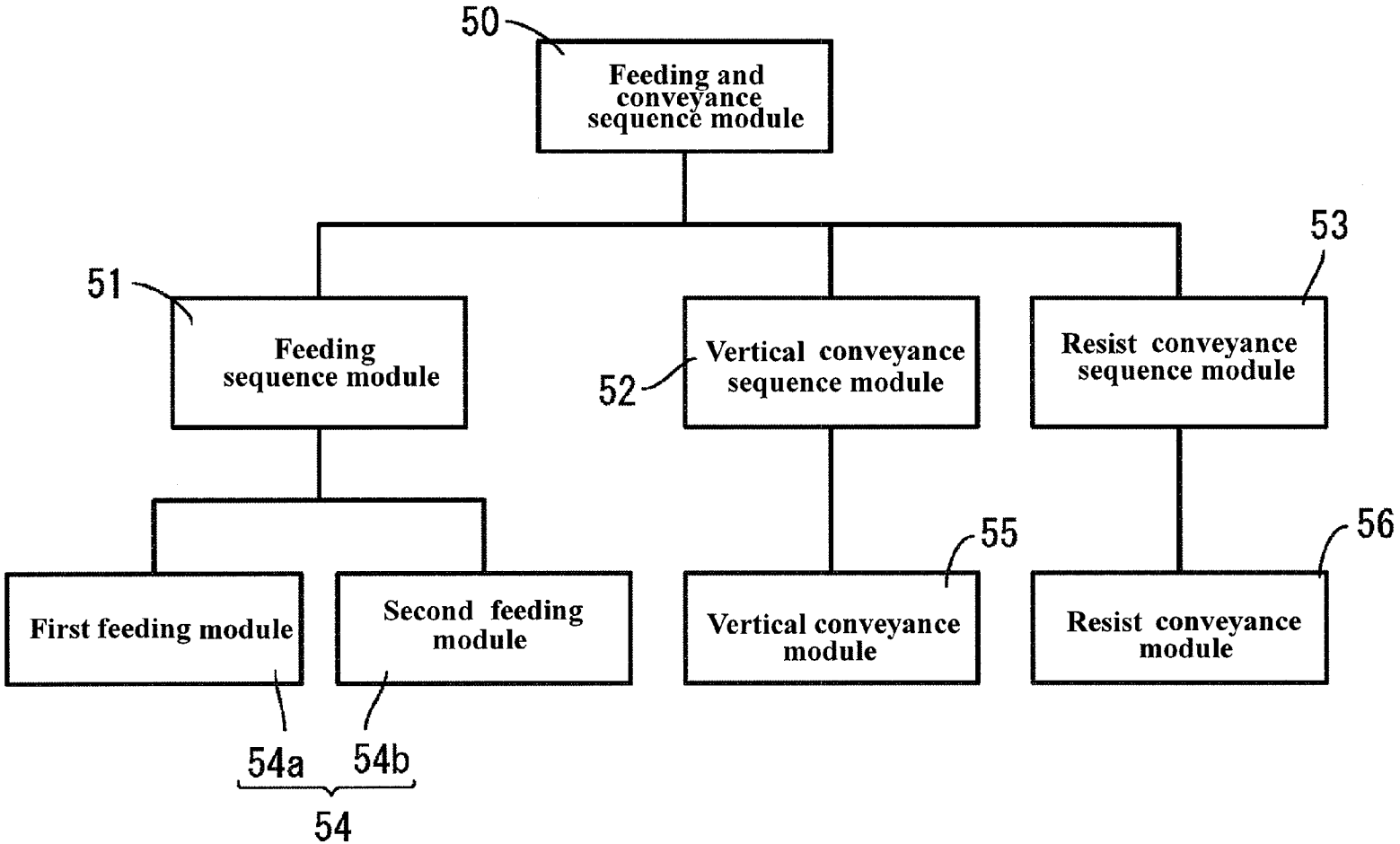
FIG. 4 is a functional block diagram illustrating a feeding control system.

FIG. 4 is a functional block diagram illustrating a feeding and conveyance control system, which is a part of the functional configuration (module configuration) of the controller 10. The feeding and conveyance control system shown in FIG. 4 includes a feeding sequence module 51, a vertical conveyance sequence module 52, a resist conveyance sequence module 53, and a feeding and conveyance sequence module 50. The feeding sequence module 51 executes sequence control of a feeding sequence module 54 with respect to the feeding mechanism 35. The vertical conveyance sequence module 52 executes sequence control of a vertical conveyance module 55 with respect to the vertical conveyance mechanism 36. The resist conveyance sequence module 53 executes sequence control of a resist conveyance module 56 with respect to the resist conveyance mechanism 37. The feeding and conveyance sequence module 50 executes overall management of the sequence modules 51 to 53.

The feeding and conveyance sequence module 50 is a module (functional unit) to execute a series of feeding and conveyance sequence control, which ranges from feeding a single recording sheet of media P to the conveyance of the recording sheet of media P past the pair of resist rollers 14. The feeding and conveyance sequence module 50 executes overall management of the control of the feeding and conveyance control system. During a printing operation, the feeding and conveyance sequence module 50 is activated on a single recording sheet P basis at a command from a system module (not shown) that executes overall management of the MFP 1. In accordance with state transition, the feeding and conveyance sequence module 50 periodically activates its subordinate feeding sequence module 51, vertical conveyance sequence module 52, and resist conveyance sequence module 53. Upon completion of sequence control of all the activated sequence modules 51 to 53, the feeding and conveyance sequence module 50 ends the processing and returns the completion state to the system module that caused the activation.

The feeding and conveyance sequence module 50 defines an identifier indicating whether the vertical conveyance mechanism 36 exists and synchronization data for determining a conveyance timing (synchronization timing) associated with the transfer position 24. Changing the identifier in accordance with whether the vertical conveyance mechanism 36 exists ensures unambiguous determination of control parameters for the respective subordinate sequence modules 51 to 53. The synchronization data is updated in every cycle and notified to the subordinate sequence modules 51 to 53 in every cycle. The feeding and conveyance sequence module 50 includes inter-module interfaces such as an initialization function, a main function for activation by the system module, and a function for returning the state of the feeding and conveyance sequence control. The identifier may be a compile switch or a variable parameter. As is apparent from the above description, the feeding and conveyance sequence module 50 is a superior sequence module that executes overall management of the control of the feeding and conveyance control system, and does not activate modules related to apparatus configurations other than the feeder 7. In other words, the feeding and conveyance sequence module 50 is an independent program part unaffected by changes in apparatus configurations other than the feeder 7.

The feeding sequence module 51 executes a series of feeding sequence control using the feeding sequence module 54 with respect to the feeding mechanism 35. This sequence control ranges from picking up the recording sheet of media P from the sheet feed cassette 11 to the conveyance of the recording sheet of media P past the pair of feeding rollers 13. The feeding sequence module 51 is activated on a single recording sheet P basis at a command from the feeding and conveyance sequence module 50. The feeding sequence module 51 defines data of the feeding start timing and a feeding control parameter of the feeding mechanism 35. The feeding control parameter needs to be set in accordance with whether the vertical conveyance mechanism 36 exists (in accordance with the identifier). Changing the feeding control parameter in accordance with the identifier ensures setting of whether to execute the vertical conveyance sequence control by the vertical conveyance sequence module 52, and addresses changes in the control specifications of the feeding mechanism 35.

The feeding sequence module 51 includes inter-module interfaces such as a main function for periodic activation by the feeding and conveyance sequence module 50, a function for acquiring a notification of the feeding start timing, a function for returning the state of the feeding sequence control, an initialization function, and a function for acquiring synchronization data. The inter-module interfaces also include a function for acquiring a skew stop command from the resist conveyance sequence module 53 and a resist drive command from the resist conveyance sequence module 53.

The vertical conveyance sequence module 52 executes a series of vertical conveyance sequence control using the vertical conveyance module 55 with respect to the vertical conveyance mechanism 36. This sequence control involves the conveyance of the recording sheet of media P past the pair of vertical conveyance rollers 31. The vertical conveyance sequence module 52 is also activated on a single recording sheet P basis at a command from the feeding and conveyance sequence module 50. The vertical conveyance sequence module 52 defines data of the vertical conveyance stop timing and a vertical conveyance control parameter of the vertical conveyance mechanism 36. The vertical conveyance control parameter according to this embodiment is, for example, mechanical position data such as the positions of the pair of vertical conveyance rollers 31 and the vertical conveyance sensor 33.

The vertical conveyance sequence module 52 includes inter-module interfaces such as a main function for periodic activation by the feeding and conveyance sequence module 50, a function for acquiring a notification of the vertical conveyance start timing, a function for returning the state of the vertical conveyance sequence control, an initialization function, and a function for acquiring synchronization data. The inter-module interfaces also include a function for acquiring a skew stop command from the resist conveyance sequence module 53 and a function for acquiring a resist drive command from the resist conveyance sequence module 53.

The resist conveyance sequence module 53 executes a series of resist conveyance sequence control using the resist conveyance module 56 with respect to the resist conveyance mechanism 37. This sequence control ranges from subjecting the recording sheet of media P to the skew correction, the loop forming, and the like to the conveyance of the recording sheet of media P past the pair of resist rollers 14. The resist conveyance sequence module 53 defines data of the resist start timing, data of the skew correction start timing, and data of the resist stop timing. The resist conveyance sequence module 53 includes inter-module interfaces such as a main function for periodic activation by the feeding and conveyance sequence module 50, a resist conveyance sequence function for activation at time intervals shorter than those of the feeding and conveyance sequence control, a function for disclosing the resist start timing to the feeding and conveyance sequence module 50, a function for acquiring a notification of the resist start timing, a function for returning the state of the resist conveyance sequence control, an initialization function, and a function for acquiring synchronization data.

The feeding sequence module 54 has a recursive structure that defines all data required for controlling the feeding mechanism 35 and is activated with parameters for the data set by the feeding sequence module 51. The feeding sequence module 54 controls the feeding motor 16 and the feeding sensor 18 based on the feeding sequence control by the feeding sequence module 51. The feeding sequence module 54 in this case sets modules 54*a* and 54*b*, which are mutually different depending on whether the vertical conveyance mechanism 36 exists. In this embodiment, the first feeding module 54*a* is assumed the case where the vertical conveyance mechanism 36 does not exist, while the second feeding module 54*b* is assumed the case where the vertical conveyance mechanism 36 exists.

The first feeding module 54*a* defines data of the feeding speed, the ON operation timing of the feeding sensor, the resist sensor 19 value, the position of the recording sheet of media in the conveyance path 15, and the rear end position of the recording sheet of media at the time when the pair of feeding rollers 13 are stopped (hereinafter referred to as feeding completion position). The data of the position of the recording sheet of media and the data of the feeding completion position may be obtained from the feeding speed and the result of detection of the forward end of the recording sheet of media P by the feeding sensor 18. Alternatively, the data of the position of the recording sheet of media and the data of the feeding completion position may be obtained from the time elapsed after the feeding sensor 18 has detected the forward end of the recording sheet of media P. The feeding sequence module 51 sets feeding control parameters for the data. The feeding control parameters are notified to the first feeding module 54*a* as arguments of the main function of the first feeding module 54*a*. The first feeding module 54*a* includes inter-module interfaces such as a main function for periodic activation by the feeding sequence module 51, a function for acquiring a drive command related to the feeding sequence control, a function for returning the state of the sequence control by the main function, a function for acquiring a drive command related to the resist drive command, and a function for acquiring a stop command related to the skew stop command.

The second feeding module 54*b* defines data of feeding motor parameters (such as the feeding speed and the gain current value), the ON operation timing of the feeding sensor, the resist sensor 19 value, and the position of the recording sheet of media in the conveyance path 15. Similarly to the first feeding module 54*a*, the data of the position of the recording sheet of media may be obtained from the feeding speed and the result of detection of the forward end of the recording sheet of media P by the feeding sensor 18. Alternatively, the data of the position of the recording sheet of media may be obtained from the time elapsed after the feeding sensor 18 has detected the forward end of the recording sheet of media P. The feeding sequence module 51 sets parameters for the data. The parameters are notified to the second feeding module 54*b* as arguments of the main function of the second feeding module 54*b*. The second feeding module 54*b* includes inter-module interfaces such as a main function for periodic activation by the feeding sequence module 51, a function for acquiring a drive command associated with the pair of feeding rollers 13, and a function for returning the state of the sequence control by the main function.

The vertical conveyance module 55 controls the vertical conveyance motor 32 and the vertical conveyance sensor 33 based on the vertical conveyance sequence control by the vertical conveyance sequence module 52. The vertical conveyance module 55 is activated at a command from the vertical conveyance sequence module 52. The vertical conveyance module 55 defines vertical motor parameters (such as the driving speed and the gain current value), and the vertical conveyance sensor 33 value. The vertical conveyance module 55 includes inter-module interfaces such as a function for returning the vertical conveyance sensor 33 value to the vertical conveyance sequence module 52, a function for acquiring a drive command associated with the pair of vertical conveyance rollers 31, and an initialization function.

The resist conveyance module 56 controls the pair of resist rollers 14 and the resist sensor 19 based on the resist conveyance sequence control by the resist conveyance sequence module 53. The resist conveyance module 56 is activated at a command from the resist conveyance sequence module 53. The resist conveyance module 56 defines resist motor parameters (such as the driving speed and the gain current value), and the resist sensor 19 value. The resist conveyance module 56 includes inter-module interfaces such as a function for returning the resist sensor 19 value to the resist conveyance sequence module 53, a function for acquiring a drive command associated with the pair of resist rollers 14, and an initialization function.

Figure 5A:
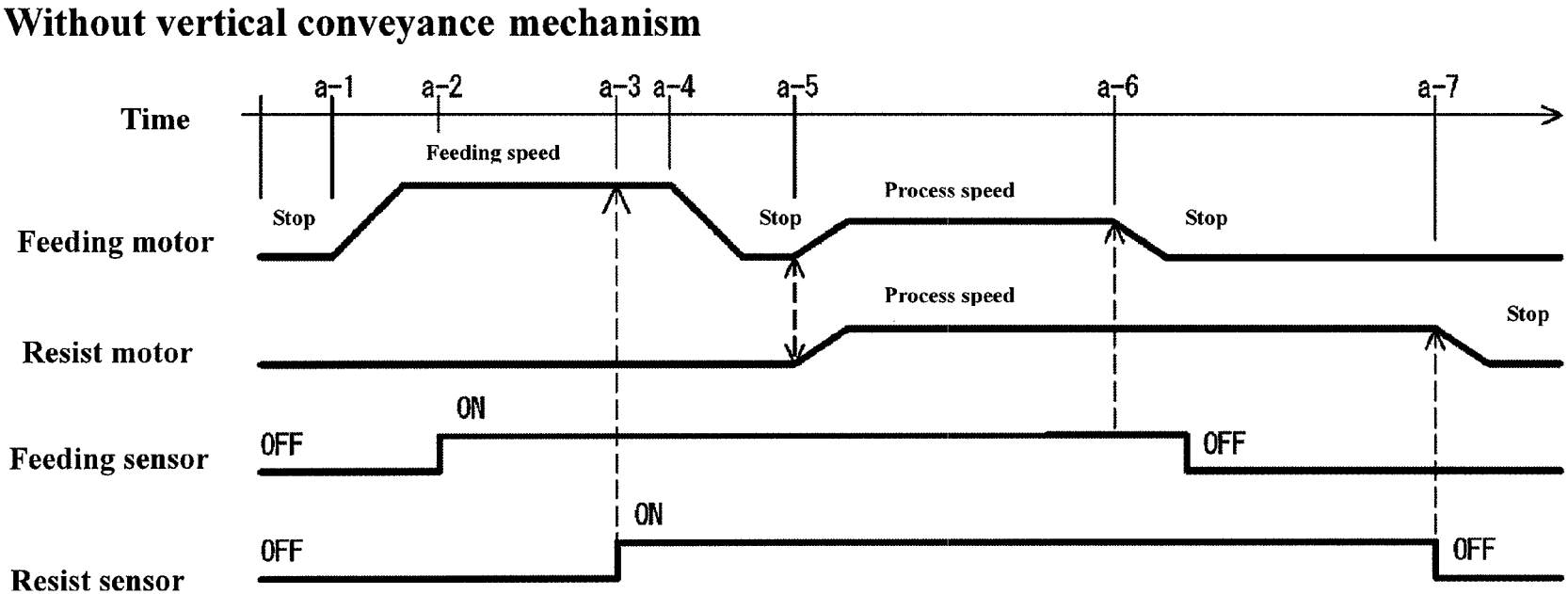
FIG. 5A is a timing chart schematically illustrating a conveyance operation in the case where the vertical conveyance mechanism does not exist.
Figure 5B:
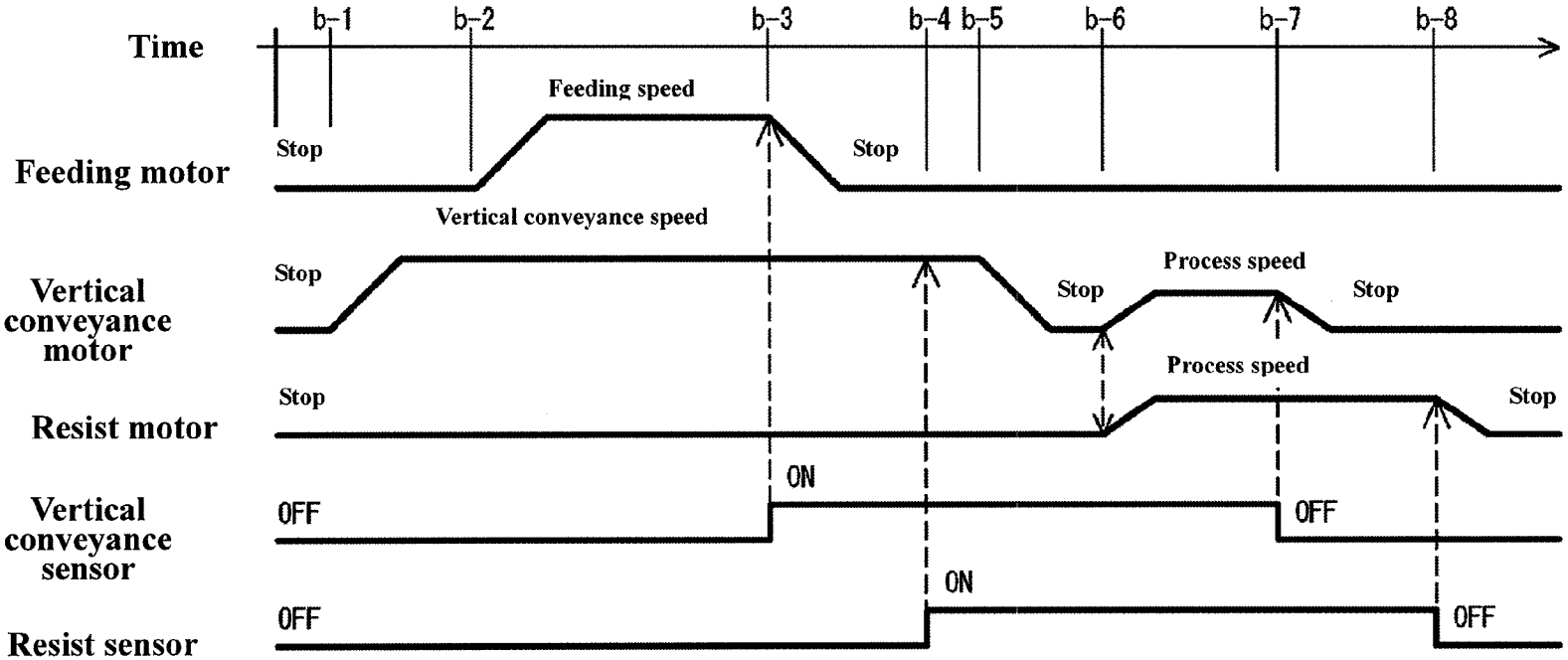
FIG. 5B is a timing chart schematically illustrating a conveyance operation in the case where the vertical conveyance mechanism exists.

FIGS. 5A and 5B are timing charts schematically describing a conveyance operation of a single recording sheet of media P, which ranges from feeding of the recording sheet of media P to the conveyance of the recording sheet of media P past the pair of resist rollers 14. FIG. 5A shows the case where the vertical conveyance mechanism 36 does not exist, while FIG. 5B shows the case where the vertical conveyance mechanism 36 exists.

The conveyance operation in the case where the vertical conveyance mechanism 36 does not exist will be described by referring to FIG. 5A. First, the feeding motor 16 is driven to start driving of the pair of feeding rollers 13 (as well as the pick-up roller 12) (a-1). This causes the uppermost recording sheet of media P in the sheet feed cassette 11 to be picked up, thus starting the feeding. The driving speed (feeding speed) of the feeding motor 16 is higher than the process speed of the various driving sources of the MFP 1. When the forward end of the recording sheet of media P passes through the pair of feeding rollers 13 and reaches the feeding sensor 16, then the feeding sensor 18 is turned on (a-2). When the forward end of the recording sheet of media P further advances to the vicinity of the pair of resist rollers 14, the resist sensor 19 is turned on (a-3). When, after the resist sensor 19 is turned on, the recording sheet of media P is conveyed to reach, at its rear end, the feeding completion position for loop formation, then the feeding motor 16 is stopped (a-4), so as to stop the pair of feeding rollers 13.

Then, the feeding motor 16 and the resist motor 17 are simultaneously driven at the synchronization timing so as to synchronously start driving of the pair of feeding rollers 13 and the pair of resist rollers 14. This causes the recording sheet of media P to be conveyed to the transfer position 24 (a-5). At this stage, the driving speeds of the feeding motor 16 and the resist motor 17 are set at the process speed. Subsequently, at the time when the rear end of the recording sheet of media P passes through the pair of feeding rollers 13, the feeding motor 16 is stopped (a-6), so as to stop the pair of feeding rollers 13. At the time when the recording sheet of media P further advances to have its rear end pass through the feeding sensor 18 and the resist sensor 19, the resist motor 17 is stopped (a-7), so as to stop the pair of resist rollers 14.

The conveyance operation in the case where the vertical conveyance mechanism 36 exists will be described by referring to FIG. 5B. First, the vertical conveyance motor 32 is driven to start driving of the pair of vertical conveyance rollers 31 (b-1). Then, the feeding motor 16 is driven to start driving of the pair of feeding rollers 13 (as well as the pick-up roller 12) (b-2). This causes the uppermost recording sheet of media P in the sheet feed cassette 11 to be picked up, thus starting the feeding. At this stage, the driving speeds of the vertical conveyance motor 31 and the feeding motor 16 are higher than the process speed.

At the time when the forward end of the recording sheet of media P passes through the pair of conveyance rollers 31 and reaches the vertical conveyance sensor 33, the vertical conveyance sensor 33 is turned on and the feeding motor 16 is stopped (b-3), so as to stop the pair of feeding rollers 13. The recording sheet of media P is conveyed on between the pair of vertical conveyance rollers 31. At the time when the recording sheet of media P further advances to have its forward end reach the vicinity of the pair of resist rollers 14, the resist sensor 19 is turned on (b-4). When, after the resist sensor 19 is turned on, the recording sheet of media P is conveyed to a degree equivalent to the loop formation, the vertical conveyance motor 32 is stopped (b-5), so as to stop the pair of vertical conveyance rollers 31.

Then, the vertical conveyance motor 32 and the resist motor 17 are synchronously driven at the synchronization timing so as to synchronously start driving of the pair of vertical conveyance rollers 31 and the pair of resist rollers 14. This causes the recording sheet of media P to be conveyed to the transfer position 24 (b-6). At this stage, the driving speeds of the vertical conveyance motor 32 and the resist motor 17 are set at the process speed. Then, at the time when the rear end of the recording sheet of media P passes through the vertical conveyance sensor 33, the vertical conveyance motor 32 is stopped (b-7), so as to stop the pair of vertical conveyance rollers 31. At the time when the recording sheet of media P further advances to have its rear end pass through the resist sensor 19, the resist motor 17 is stopped (b-8), so as to stop the pair of resist rollers 14.

Figure 6:
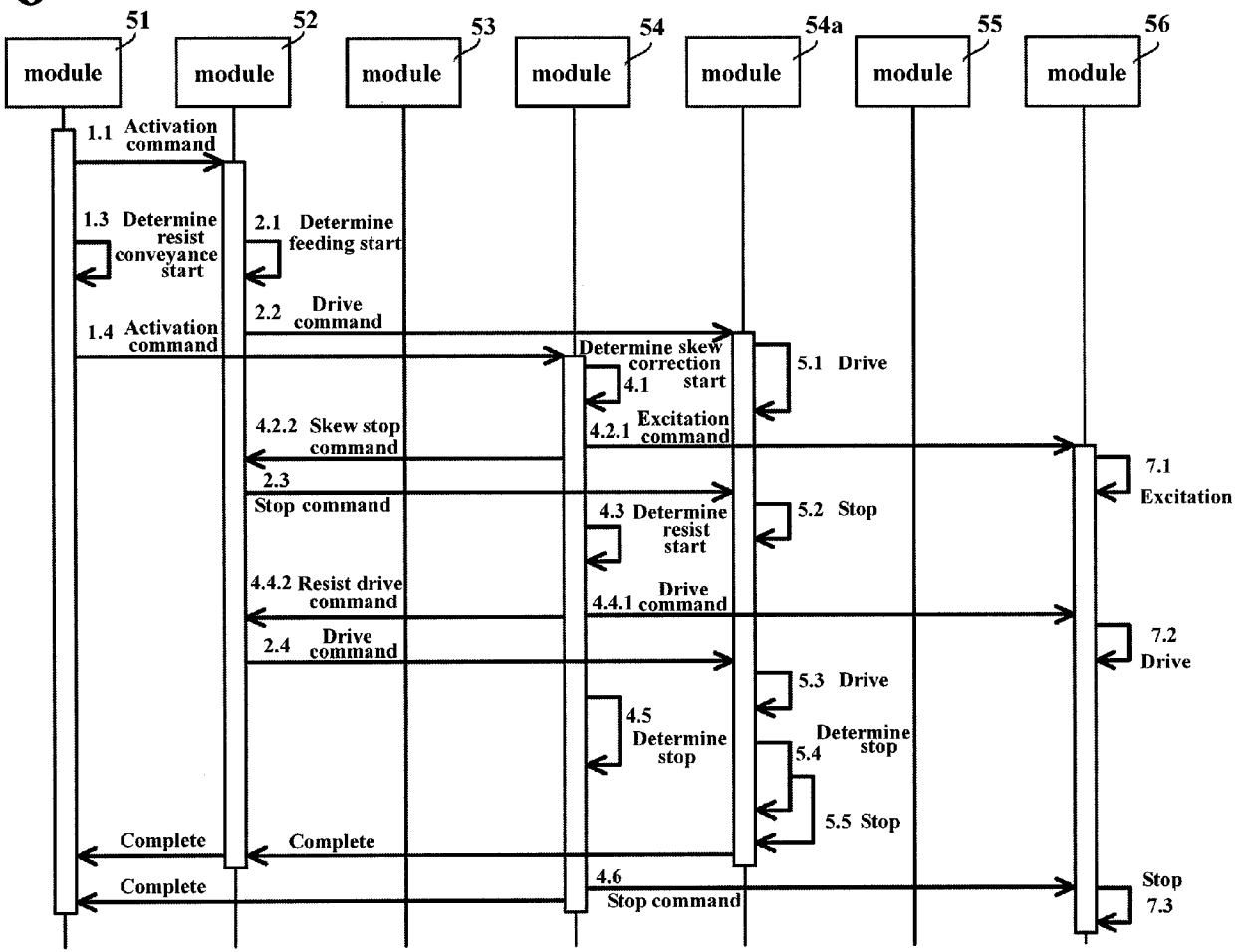
FIG. 6 is a sequence chart schematically illustrating the conveyance operation in the case where the vertical conveyance mechanism does not exist.
Figure 7:
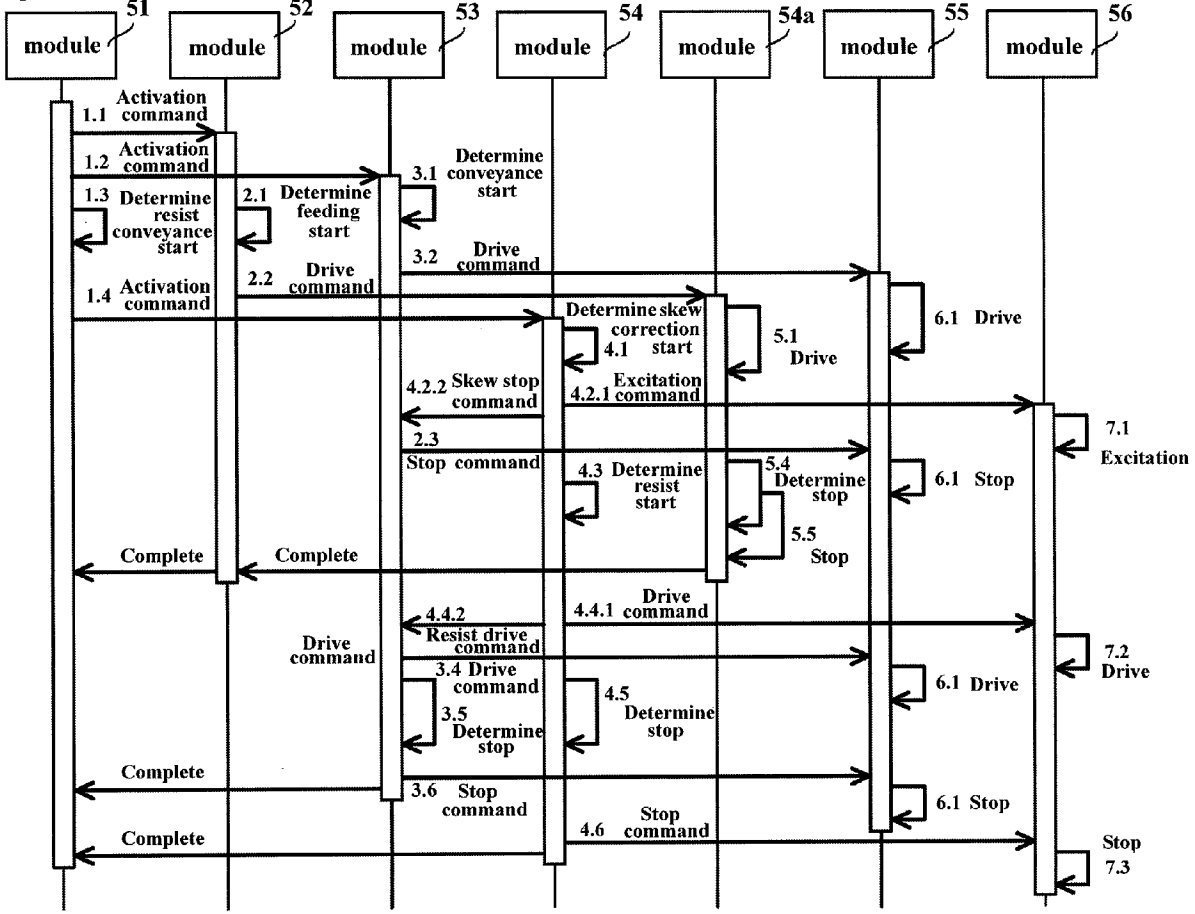
FIG. 7 is a sequence chart schematically illustrating the conveyance operation in the case where the vertical conveyance mechanism exists.

FIGS. 6 and 7 are sequence charts schematically illustrating a conveyance operation of the single recording sheet of media P, which ranges feeding of the recording sheet of media P to the conveyance of the recording sheet of media P past the pair of resist rollers 14. FIG. 6 shows the case where the vertical conveyance mechanism 36 does not exist, while FIG. 7 shows the case where the vertical conveyance mechanism 36 exists. The following description and drawings omit the stage of activation of the feeding and conveyance sequence module 50 at a command from the system module (not shown) that executes overall management of the MFP 1.

First, the sequence control shown in FIG. 6 will be described. First, the feeding and conveyance sequence module 50 issues an activation command to the feeding sequence module 51 (1.1). In the case of FIG. 6, the identifier indicates that the vertical conveyance mechanism 36 does not exist, and therefore no activation command is issued to the vertical conveyance sequence module 52. Then, the feeding and conveyance sequence module 50 determines the activation timing of the resist conveyance sequence module 53 (1.3), and upon arrival of the activation timing, issues an activation command to the resist conveyance sequence module 53 (1.4). The activation of the main functions of the sequence modules 51 and 53 are maintained until the sequence control of the activated sequence modules 51 and 53 is complete. During activation of the sequence modules 51 and 53, the feeding and conveyance sequence module 50 updates the synchronization data in every cycle, and notifies the synchronization data to the subordinate sequence modules 51 and 53 in every cycle, which is not elaborated in the drawings.

Upon receipt of the activation command from the feeding and conveyance sequence module 50, the feeding sequence module 51 starts the feeding sequence control (that is, activates the main function), and determines whether the synchronization data acquired in every cycle has reached the feeding start timing (2.1). When the feeding start timing is reached, the feeding sequence module 51 issues a drive command to the first feeding module 54*a* (2.2). The first feeding module 54*a* controls the feeding motor 16 and the feeding sensor 18 (feeding mechanism 35) based on feeding control parameters set by the feeding sequence module 51 (5.1).

Upon receipt of the activation command from the feeding and conveyance sequence module 50, the resist conveyance sequence module 53 starts the resist conveyance sequence control (that is, activates the main function), and determines whether the synchronized data acquired in every cycle has reached the skew correction start timing (4.1). When the skew correction start timing is reached, the resist conveyance sequence module 53 issues an excitation command to the resist conveyance module 56 (4.2.1) and then issues a skew stop command to the feeding sequence module 51 at a predetermined timing (4.2.3). Upon receipt of the skew stop command from the resist conveyance sequence module 53, the feeding sequence module 51 issues a stop command associated with the pair of feeding rollers 13 to the first feeding module 54*a* (2.3), so as to stop the feeding motor 16 (feeding mechanism 35) (5.2). These steps correspond to the flow in the timing chart of FIG. 5A through to (a-4).

Then, the resist conveyance sequence module 53 determines whether the synchronization data acquired in every cycle has reached the resist start timing (4.3). When the resist start timing is reached, the resist conveyance sequence module 53 issues a drive command associated with the pair of resist rollers 14 to the resist conveyance module 56 (4.4.1), so as to drive the resist motor 17 (resist conveyance mechanism 37) (7.2). At the same time, the resist conveyance sequence module 53 issues a resist drive command to the feeding sequence module 51 (4.4.3). Upon receipt of the resist drive command from the resist conveyance sequence module 53, the feeding sequence module 51 issues a drive command associated with the pair of feeding rollers 13 to the first feeding module 54*a* (2.4), so as to drive the feeding motor 16 (feeding mechanism 35) (5.3). These steps correspond to the flow in the timing chart of FIG. 5A through to (a-5).

Then, the first feeding module 54*a* makes a stop determination based on the data of the position of the recording sheet of media and the data of the feeding stop timing acquired from the feeding sequence module 51 (5.4), so as to stop the feeding motor 16 (feeding mechanism 35) (5.5). Upon stopping of the feeding motor 16, the first feeding module 54*a* returns a sequence control completion to the feeding sequence module 51. In response, the feeding sequence module 51 returns the completion state of the feeding sequence control to the feeding and conveyance sequence module 50. These steps correspond to the flow in the timing chart of FIG. 5A through to (a-6).

Then, the resist conveyance sequence module 53 determines whether the resist stop timing is reached (4.5). When the resist stop timing is reached, the resist conveyance sequence module 53 issues a stop command associated with the pair resist rollers 14 to the resist conveyance module 56

(4.6), so as to stop the resist motor 17 (resist conveyance mechanism 37) (7.3). The resist conveyance sequence module 53 returns the completion state of the resist conveyance sequence control to the feeding and conveyance sequence module 50. These steps correspond to the flow in the timing chart of FIG. 5A through to (a-7). Upon receipt of the completion states of the feeding sequence module 51 and the resist conveyance sequence module 53, the feeding and conveyance sequence module 50 ends its feeding and conveyance sequence control.

Next, the sequence control shown in FIG. 7 will be described. First, the feeding and conveyance sequence module 50 issues an activation command to the feeding sequence module 51 (1.1). In the case of FIG. 7, the identifier indicates that the vertical conveyance mechanism 36 exists, and therefore the feeding and conveyance sequence module 50 also issues an activation command to the vertical conveyance sequence module 52 (1.2). Then, the feeding and conveyance sequence module 50 determines the activation timing of the resist conveyance sequence module 53 (1.3), and upon arrival of the activation timing, issues an activation command to the resist conveyance sequence module 53 (1.4). The activation of the main functions of the sequence modules 51 and 53 are maintained until the sequence control of the activated sequence modules 51 and 53 is complete. During activation of the sequence modules 51 and 53, the feeding and conveyance sequence module 50 updates the synchronization data in every cycle, and notifies the synchronization data to the subordinate sequence modules 51 and 53 in every cycle, which is not elaborated in the drawings.

Upon receipt of the activation command from the feeding and conveyance sequence module 50, the feeding sequence module 51 starts the feeding sequence control (that is, activates the main function), and determines whether the synchronization data acquired in every cycle has reached the feeding start timing (2.1). When the feeding start timing is reached, the feeding sequence module 51 issues a drive command to the second feeding module 54*b* (2.2). The second feeding module 54*b* controls the feeding motor 16 and the feeding sensor 18 (feeding mechanism 35) based on feeding control parameters set by the feeding sequence module 51 (5.1).

Upon receipt of the activation command from the feeding and conveyance sequence module 50, the vertical conveyance sequence module 52 starts the vertical conveyance sequence control (that is, activates the main function), and determines whether the synchronization data acquired in every cycle has reached the vertical conveyance timing (3.1). When the vertical conveyance timing is reached, the vertical conveyance sequence module 52 issues a drive command to the vertical conveyance module 55 (3.2). The vertical conveyance module 55 controls the vertical conveyance motor 32 and the vertical conveyance sensor 33 (vertical conveyance mechanism 36) based on vertical conveyance control parameters (6.1). These steps correspond to the flow in the timing chart of FIG. 5B through to (b-2).

Upon receipt of the activation command from the feeding and conveyance sequence module 50, the resist conveyance sequence module 53 starts the resist conveyance sequence control (that is, activates the main function), and determines whether the synchronized data acquired in every cycle has reached the skew correction start timing (4.1). When the skew correction start timing is reached, the resist conveyance sequence module 53 issues an excitation command to the resist conveyance module 56 (4.2.1) and then issues a skew stop command to the vertical conveyance sequence module 52 at a predetermined timing (4.2.2). Upon receipt of the skew stop command from the resist conveyance sequence module 53, the vertical conveyance sequence module 52 issues a stop command associated with the pair of vertical conveyance rollers 31 to the vertical conveyance module 55 (3.3), so as to stop the vertical conveyance motor 32 (vertical conveyance mechanism 36) (6.2).

Meanwhile, the second feeding module 54*b* makes a stop determination based on the feeding control parameters set by the feeding sequence module 51 (5.4), so as to stop the feeding motor 16 (feeding mechanism 35) (5.5). After stopping the feeding motor 16, the second feeding module 54*b* returns a sequence control completion to the feeding sequence module 51. In response, the feeding sequence module 51 returns the completion state of the feeding sequence control to the feeding and conveyance sequence module 50. These steps correspond to the flow in the timing chart of FIG. 5B through to (b-4).

Then, the resist conveyance sequence module 53 determines whether the synchronization data acquired in every cycle has reached the resist start timing (4.3). When the resist start timing is reached, the resist conveyance sequence module 53 issues a drive command associated with the pair of resist rollers 14 to the resist conveyance module 56 (4.4.1), so as to drive the resist motor 17 (resist conveyance mechanism 37) (7.2). At the same time, the resist conveyance sequence module 53 issues a resist drive command to the vertical conveyance sequence module 52 (4.4.2). Upon receipt of the resist drive command from the resist conveyance sequence module 53, the vertical conveyance sequence module 52 issues a drive command associated with the pair of vertical conveyance rollers 31 to the vertical conveyance module 55 (3.4), so as to drive the vertical conveyance motor 32 (vertical conveyance mechanism 36) (6.3). These steps correspond to the flow in the timing chart of FIG. 5B through to (b-6).

Subsequently, the vertical conveyance sequence module 52 makes a stop determination based on the vertical conveyance sensor 33 value (which indicates whether an OFF operation has been made) (3.5). Then, the vertical conveyance sequence module 52 issues a stop command associated with the pair of vertical conveyance rollers 31 to the vertical conveyance module 55 (3.6), so as to stop the vertical conveyance motor 32 (vertical conveyance mechanism 36) (6.4). The vertical conveyance sequence module 52 returns the completion state of the vertical conveyance sequence control to the feeding and conveyance sequence module 50. These steps correspond to the flow in the timing chart of FIG. 5B through to (b-7).

Then, the resist conveyance sequence module 53 determines whether the resist stop timing is reached (4.5). When the resist stop timing is reached, the resist conveyance sequence module 53 issues a stop command associated with the pair resist rollers 14 to the resist conveyance module 56 (4.6), so as to stop the resist motor 17 (resist conveyance mechanism 37) (7.3). The resist conveyance sequence module 53 returns the completion state of the resist conveyance sequence control to the feeding and conveyance sequence module 50. These steps correspond to the flow in the timing chart of FIG. 5B through to (b-8). Upon receipt of the completion states of the three sequence modules 51 to 53, the feeding and conveyance sequence module 50 ends its feeding and conveyance sequence control.

As is apparent from the above description, the module structure according to this embodiment readily addresses differences in apparatus specifications such as whether the vertical conveyance mechanism 36 exists. Specifically, the differences in apparatus specifications are addressed by changing the identifier defined in the feeding and conveyance sequence module 50 in basically a single type of feeding and conveyance control program. This eliminates or minimizes the need for establishing separate feeding control programs to accommodate differences in apparatus specifications (such as whether the vertical conveyance mechanism 36 exists). Thus, differences in apparatus specifications do not matter in applying the feeding control program of this embodiment. This ensures a versatile (reusable) feeding control program and contributes to improving efficiency in software development, such as a reduction in the development time.

In particular, in the feeding control program of this embodiment, changing the identifier involves only two changes in the control specifications, namely, changing the parameter for the feeding stop timing of the feeding and conveyance sequence module 50, and making a switch in the feeding sequence module 54 of the feeding sequence module 51. Thus, it is easy to address the change of the identifier. No changes are necessary in the other sequence modules 52 and 53. Moreover, the feeding sequence module 54 is the only dedicated module necessary to accommodate differences in the apparatus specifications. These respects prove high versatility (reusability) of the feeding control program of this embodiment.

In this embodiment, the feeding sequence module 54, the vertical conveyance module 55, and the resist conveyance module 56 control their respective mechanisms 35 to 37 at time intervals shorter than reference time intervals at which the feeding and conveyance sequence control is executed by the feeding and conveyance sequence module 50. This control ensures, for example, driving of the motors 16, 17, and 32 at short intervals so as to provide delicate driving of the pairs of rollers 13, 14, and 31. This improves the adjustment accuracy of the amount of loop formation of the recording sheet of media P, and improves the positioning accuracy of the recording sheet of media P with respect to the toner image.

It will be appreciated that the present invention will not be limited to the embodiments described above and can be embodied in various other forms. For example, while an MFP has been described as an exemplary image forming apparatus, this should not be construed in a limiting sense. Other possible examples include copiers, fax machines, and printers. The storage medium is not limited to the hard disk 44. Other possible examples include, but not limited to: semiconductor memories such as ROM, RAM, and a flash memory; memory devices such as an integrated circuit; optical disks; magnetic optical disks such as CD-ROM, DVD-RAM, DVD-ROM, and MO; and magnetic recording media such as a floppy disc (registered trademark) and ZIP.

This embodiment readily addresses differences in apparatus specifications by changing the identifier defined in the feeding and conveyance sequence module 50 in basically a single type of feeding and conveyance control program. This eliminates or minimizes the need for establishing separate feeding control programs to accommodate differences in apparatus specifications. Thus, differences in apparatus specifications do not matter in applying the feeding control program of this embodiment. This ensures a versatile (reusable) feeding control program and contributes to improving efficiency in software development, such as a reduction in the development time.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A computer readable storage medium storing a feeding and conveyance control program for controlling a recording medium to be fed and conveyed to a transfer position, the feeding and conveyance control program causing a computer to perform:

executing sequence control of a feeding sequence module with respect to a feeding mechanism configured to feed the recording medium, the sequence control comprising two kinds of sequence control executed in accordance with an identifier indicating whether the vertical conveyance mechanism configured to relay conveyance of the recording medium exists;

executing sequence control of a vertical conveyance sequence module with respect to the vertical conveyance mechanism;

executing sequence control of a resist conveyance sequence module with respect to a resist conveyance mechanism configured to convey the recording medium to the transfer position at a predetermined timing; and executing sequence control for overall management of the feeding sequence module, the vertical conveyance sequence module, and the resist conveyance sequence module, the overall management comprising determining, based on the identifier, whether to execute the sequence control of the vertical conveyance sequence module.

2. The storage medium according to claim 1, wherein the overall management comprises issuing an activation command to the sequence control of the vertical conveyance sequence module when the identifier indicates that the vertical conveyance mechanism exists, while not issuing the activation command to the sequence control of the vertical conveyance sequence module when the identifier indicates that the vertical conveyance mechanism does not exist.

3. The storage medium according to claim 1, wherein when the identifier indicates that the vertical conveyance mechanism exists, the sequence control of the feeding sequence module comprises setting a feeding stop timing at an ON operation timing of a vertical conveyance detector configured to detect the recording medium being conveyed, while when the identifier indicates that the vertical conveyance mechanism does not exist, the sequence control of the feeding sequence module comprises setting the feeding stop timing at a timing when a rear end of the recording medium passes through a predetermined feeding completion position.

4. The storage medium according to claim 1, wherein the sequence control of the feeding sequence module comprises temporarily stopping the conveyance of the recording medium so as to adjust a conveyance timing associated with the transfer position, the sequence control of the feeding sequence module comprising issuing a stop command to the feeding sequence module to stop the conveyance upon receipt of a skew stop command from the sequence control of the resist conveyance sequence module.

5. The storage medium according to claim 4, wherein the sequence control of the feeding sequence module comprises resuming the conveyance of the temporarily stopped recording medium, the sequence control of the feeding sequence module comprising issuing a drive command to the feeding sequence module to resume the conveyance upon receipt of a resist drive command from the sequence control of the resist conveyance sequence module.

6. The storage medium according to claim 3, wherein the sequence control of the vertical conveyance sequence module comprises temporarily stopping the conveyance of the recording medium so as to adjust a conveyance timing associated with the transfer position, the sequence control of the vertical conveyance sequence module comprising issuing a stop command to the vertical conveyance sequence module to stop the conveyance upon receipt of a skew stop command from the sequence control of the resist conveyance sequence module.

7. The storage medium according to claim 6, wherein the sequence control of the vertical conveyance sequence module comprises resuming the conveyance of the temporarily stopped recording medium, the sequence control of the vertical conveyance sequence module comprising issuing a drive command to the vertical conveyance sequence module to resume the conveyance upon receipt of a resist drive command from the sequence control of the resist conveyance sequence module.

8. The storage medium according to claim 4, wherein the feeding sequence module, the vertical conveyance sequence module, and the resist conveyance sequence module are configured to respectively control the feeding mechanism, the vertical conveyance mechanism, and the resist conveyance mechanism at time intervals shorter than reference time intervals at which the sequence control for the overall management is executed by a feeding and conveyance sequence module.

9. An image forming apparatus comprising the storage medium according to claim 1.

* * * * *